US005851481A

United States Patent [19]

Stankus et al.

[11] Patent Number: 5,851,481

[45] Date of Patent: Dec. 22, 1998

[54] REBAR WITH VANADIUM ALLOY

[75] Inventors: John C. Stankus, Canonsburg; Frank Calandra, Jr., Pittsburgh; Michael Cokus, Sarver, all of Pa.; Ray W. Goetz, Skaneateles, N.Y.

[73] Assignee: Jennmar Corporation, Pittsburgh, Pa.

[21] Appl. No.: 863,828

[22] Filed: May 27, 1997

[51] Int. Cl.[6] ..... C22C 38/12; E21D 20/00

[52] U.S. Cl. ..... 420/127; 420/93; 420/120; 148/320; 148/332; 405/254.1

[58] Field of Search ..... 148/320, 332; 420/93, 120, 127; 405/259.1

[56] References Cited

U.S. PATENT DOCUMENTS

| | | | |
|---|---|---|---|
| 4,289,548 | 9/1981 | Bucher et al. | 148/320 |
| 4,486,249 | 12/1984 | Woodings | 148/320 |
| 4,605,449 | 8/1986 | Schummer et al. | 148/12 B |
| 4,784,531 | 11/1988 | Calandra, Jr. | 405/261 |
| 4,784,922 | 11/1988 | Yoshimura | 428/681 |
| 4,806,177 | 2/1989 | Held et al. | 148/320 |
| 4,836,981 | 6/1989 | Shimada et al. | 420/79 |
| 5,017,335 | 5/1991 | Bramfitt et al. | 148/320 |
| 5,403,410 | 4/1995 | Shikanai et al. | 148/328 |
| 5,565,044 | 10/1996 | Kim et al. | 148/320 |

OTHER PUBLICATIONS

Deeley, P.D. et al., Ferroalloys & Alloying Additions Handbook (1981), pp. 107–110.

ASTM F432–88, Standard Specification For Roof and Rock Bolts and Accessories, (1988), pp. 1–11.

*Primary Examiner*—John Sheehan

*Attorney, Agent, or Firm*—Webb Ziesenheim Bruening Logsdon Orkin & Hanson, P.C.

[57] ABSTRACT

A steel alloy having 0.44–0.52 wt. % C, 1.1–1.6 wt. % Mn, 0.15–0.35 wt. % Si, a maximum of 0.04 wt. % P, a maximum of 0.05 wt. % S, a maximum of 0.45 wt. % Cu and 0.06–0.09 wt. % V. A No. 5 mine roof bolt formed from the steel alloy has a minimum yield strength of 90,000 psi. A mine roof bolt having a cross-sectional diameter of ⅞ inch or 1 inch and formed from the steel alloy has a minimum yield strength of 100,000 psi.

12 Claims, 2 Drawing Sheets

REBAR WITH VANADIUM ALLOY

BACKGROUND OF THE INVENTION

1. Field of the Invention

This invention relates to a mine roof bolt made of rebar containing vanadium, and more particularly, to a high strength mine roof bolt comprising a steel alloy having vanadium and medium carbon.

2. Description of the Prior Art

Mine roof bolts used to support a mine roof which are inserted into a bore hole drilled in a mine roof and anchored therein to reinforce the unsupported rock formation above the roof are typically forged from a steel alloy in the form of an elongated cylindrical bar having a pattern of embossments along the surface and generally referred to as reinforcing bar or rebar. Such bolts are required to have minimum yield strengths for particular grades (Grade 30, Grade 55 and Grade 75) as specified by ASTM F432. Although not specified by ASTM F432, a Grade 90 bolt would have a minimum yield strength of 90,000 psi (pounds per square inch) and a Grade 100 bolt would have a minimum yield strength of 100,000 psi.

To obtain the desired mechanical properties, mine roof bolts formed from rebar typically are made from "6 bar" or "No. 6 rebar", rebar having a cross-sectional diameter of three-quarters of an inch. However, it is desirable to use a smaller diameter rebar in a mine roof bolt in order to minimize the cost of materials in the bolt and to eliminate some of the handling difficulties associated with larger diameter rebar. To that end, of particular interest are mine roof bolts formed from "5 bar" or "No. 5 rebar" (or the equivalent soft metric "16 bar") which is a rebar having a five-eighths inch diameter. Because of their reduced diameter, mine roof bolts formed from 5 bar and conventional carbon and/or alloy steels generally lack the necessary strength requirements of ASTM F432. Thus, a need has arisen for mine roof bolts having reduced cross section and improved mechanical properties to meet the requirements of ASTM F432.

Furthermore, a Grade 90 or Grade 100 bolt produced from conventional steel alloy for rebar would need to have a very large diameter making it impractical for most mines. Therefore, a particular need remains for a Grade 90 bolt and a Grade 100 bolt having acceptably small diameters.

One method of increasing the tensile strength of a mine roof bolt made of rebar is to increase the amount of carbon in the steel alloy. Carbon is usually present in rebar of mine roof bolts at about 0.5% by weight. While a steel alloy with a higher amount of carbon has a higher tensile strength, it is more difficult to forge. The higher amount of carbon thus dictates the use of generally modified and less efficient forging temperature. Therefore, a medium carbon rebar containing about 0.5 wt. % carbon remains desirable.

Accordingly, a need remains for a mine roof bolt formed of rebar having an acceptable diameter and with improved mechanical properties yet containing a medium amount of carbon and thus is forgeable under standard go conditions.

SUMMARY OF THE INVENTION

In accordance with the present invention, there is provided a mine roof bolt comprising a steel alloy having 0.44 to 0.52 wt. % carbon, 1.1 to 1.6 wt. % manganese, 0.15 to 0.35 wt. % silica, a maximum of 0.04 wt. % phosphorus, a maximum of 0.05 wt. % sulfur, a maximum of 0.45 wt. % copper and 0.06 to 0.09 wt. % vanadium. Nickel, chromium and/or molybdenum can optionally be added in the amount of trace—0.20 (Ni), trace—0.25 (Cr) and trace—0.05 (Mo). Tin and Columbian are generally residuals and neither should exceed 0.02 wt. %. The mine roof bolt of the present invention may be a Grade 90 rebar which is formed as a 5 bar or a soft metric 16 bar. The mine roof bolt of the present invention may be a Grade 100 rebar having a cross-sectional diameter of 1 inch or ⅞ inch.

DESCRIPTION OF THE PREFERRED EMBODIMENTS

Figure 1:
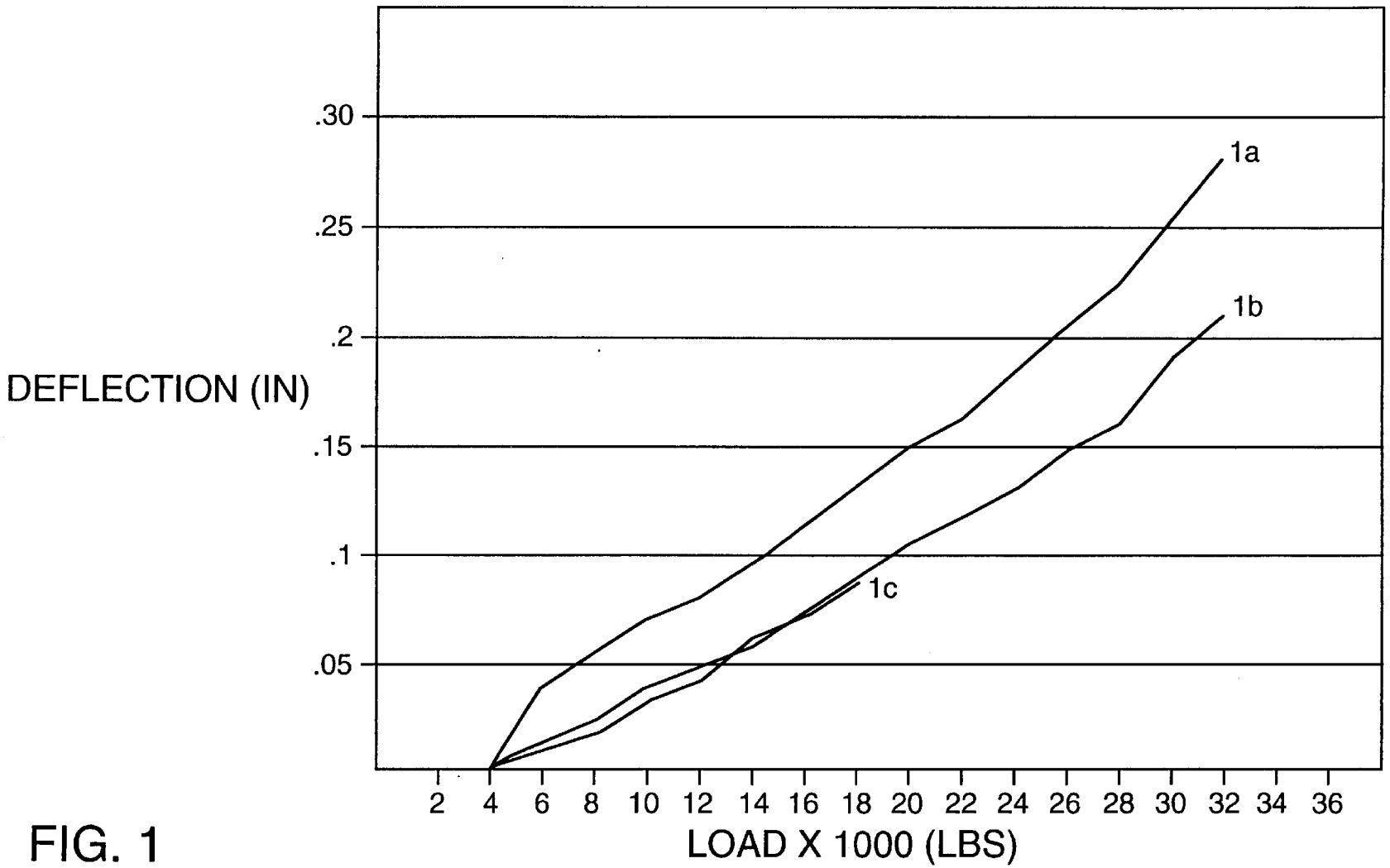
FIG. 1*a* is a graph of deflection vs. load in a pull test in a first location of a mine roof bolt formed from the steel alloy of the present invention.
FIG. 1*b* is a graph of deflection vs. load in a pull test in the first location of another mine roof bolt formed from the steel alloy of the present invention.
FIG. 1*c* is a graph of deflection vs. load in a pull test in the first location of another mine roof bolt formed from the steel alloy of the present invention.

The present invention includes a mine roof bolt comprising a steel alloy containing vanadium. Vanadium is present in the steel alloy in the amount of 0.06 to 0.09 wt. %, preferably 0.07 wt. %. All references to percents of elements in alloy are by weight. The steel alloy contains a medium level of carbon, preferably 0.44 to 0.52 wt. % carbon, more preferably 0.5 wt. % carbon and 1.1 to 1.6 wt. % manganese, preferably 1.4 wt. % manganese. The steel alloy also contains 0.15 to 0.35 wt. % silica, preferably 0.25 wt. % silica. Other elements which may be present include a maximum of 0.04 wt. % phosphorus, a maximum of 0.05 wt. % sulfur and a maximum of 0.45 wt. % copper. The alloy may also contain nickel in the amount of a trace up to 0.2 wt. %, chromium in the amount of a trace up to 0.25 wt. % and molybdenum in the amount of a trace up to 0.05 wt. %. Tin and Columbian may be present as residual elements up to 0.02 wt. % each.

The inclusion of vanadium promotes fine grain size, increases hardenability and improves wear resistance in alloy steels through the precipitation of the carbides and nitrides of vanadium. However, vanadium is a relatively expensive additive for alloy steels, especially considering the relatively low cost steels used to form rebar. It is desirable to minimize the amount of vanadium used for economical reasons. The present invention recognizes the need for a balance between the costs of adding vanadium to steel for rebar and the benefits obtained by the improved mechanical properties obtained thereby over conventional rebar formed from medium carbon steel alloy.

The steel alloy of the present invention can be made in any one of the conventional steel making methods, such as by heating scrap steel in an electric arc furnace until melted. Vanadium is added to the molten steel as an alloying addition and the melt is continuously cast into billets. Billets are reheated in a furnace and formed in a one inch bar mill, cooled and normalized. The bars are then sheared into appropriate lengths.

The steel alloy of the present invention can be formed into rebar for use as mine roof bolts. No. 5 rebar formed from the inventive steel alloy (having a cross-sectional diameter of ⅝ inch) will have a minimum yield strength of 90,000 psi. Rebar formed from the inventive steel alloy and having a cross-sectional diameter of 0.804 inch (or ⅞ inch after swaging and/or thread rolling) or 0.914 inch (or 1 inch after swaging and/or thread rolling) will have a minimum yield strength of 100,000 psi.

Although the invention has been described generally above, particular examples give additional illustration of the product and method steps typical of the present rebar containing vanadium alloy.

EXAMPLE 1

A steel alloy suitable for use in rebar was produced by melting scrap steel and making the appropriate alloying additions in an electric arc furnace. Vanadium was added to the molten steel as one of the alloying additions. The steel was continuous cast into billets of 5"×5" and 6"×6". The billets were reheated in a furnace and soaked to 2000°–2500° F. The reheated billets entered a 1" bar mill at 1850° F. and the milled bars exited the mill at about 1700° F. The bars entered a cooling bed at about 1500° F. and were air cooled and normalized at 200° F. The bars were then sheared into appropriate lengths.

Chemical analysis of the bar revealed the following composition, with the remainder being iron:

| Element | Weight % |
|---|---|
| C | 0.50 |
| V | 0.072 |
| Mn | 1.43 |
| Si | 0.25 |
| P | 0.011 |
| S | 0.021 |
| Cu | 0.12 |
| Ni | 0.05 |
| Cr | 0.07 |
| Mo | 0.34 |
| Sn | 0.008 |
| Cb | 0.004 |

EXAMPLE 2

The rebar formed according to Example 1 had the following properties:

| | |
|---|---|
| Yield K.S.I. | 93.55 |
| Tensile K.S.I. | 137.80 |
| % elongation | 12.5 |

EXAMPLE 3

The anchorage characteristics of a mine roof bolt formed of No. 5 rebar using the steel alloy produced according to Example 1 was evaluated and had the following physical properties as compared to a mine roof bolt formed of conventional No. 6 rebar:

| | Example 1 No. 5 rebar | Standard No. 6 rebar |
|---|---|---|
| Minimum yield strength (lbs) | 30,000 | 30,000 |
| Minimum tensile strength (lbs) | 42,000 | 36,000 |
| Elongation (minimum 8") | 12.5% | 10.0% |
| Weight/ft (lbs) | 1.043 | 1.234 |

EXAMPLE 4

Three samples of 5 foot lengths of the No. 5 rebar bolt of Example 3 were installed in United States Steel Mining Company Mine #50 in a 1" mine roof bore hole with a J1 ⅝" tapped expansion shell (Jennmar Corporation, Pittsburgh, Pa.), shear pin, round support nut, round hardened steel and anti-friction washer with two equivalent feet of Celtite INST àL B2 resin (Celtite Corporation, Georgetown, Ky.).

Pull collars were attached to the ends of the bolts. A pre-load of 4,000 pounds was applied using a calibrated hydraulic ram. Additional loading was applied in one-ton increments with bolt deflection readings taken as shown in FIGS. 1*a*–1*c*. One bolt (FIG. 1*c*) was not loaded past 9 tons because that bolt was inadvertently installed in a roof cavity which caused the bearing plate to deflect excessively, but when the extensometer was removed, the bolt was loaded to 33,000 lbs.

EXAMPLE 5

Figure 2:
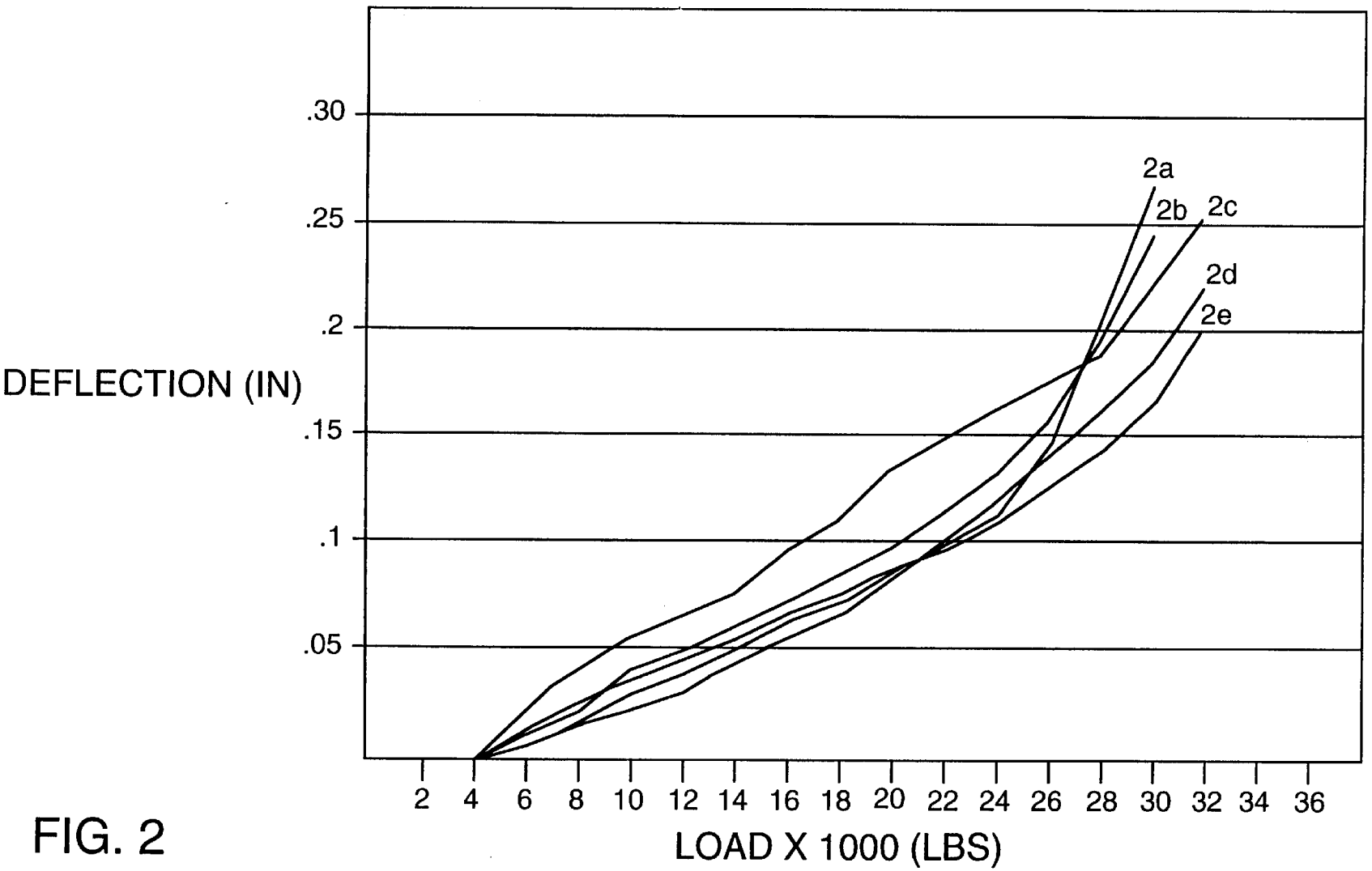
FIG. 2*a* is a graph of deflection vs. load in a pull test in a second location of another mine roof bolt formed from the steel alloy of the present invention.
FIG. 2*b* is a graph of deflection vs. load in a pull test in the second location of another mine roof bolt formed from the steel alloy of the present invention.
FIG. 2*c* is a graph of deflection vs. load in a pull test in the second location of another mine roof bolt formed from the steel alloy of the present invention.
FIG. 2*d* is a graph of deflection vs. load in a pull test in the second location of another mine roof bolt formed from the steel alloy of the present invention.
FIG. 2*e* is a graph of deflection vs. load in a pull test in the second location of another mine roof bolt formed from the steel alloy of the present invention.

Five additional samples of the mine roof bolt of Example 3 were tested in Upper Big Branch South Mine (Performance Coal Company) in accordance with the procedure of Example 4. Bolt deflection readings taken at one-ton increments are graphically presented in FIGS. 2*a*–2*e*. The extensometer of the bolt of FIG. 2*e* was removed and pulled to tensile failure of 21 tons.

EXAMPLE 6

Rebar having a diameter of 0.914 inch was made in a manner similar to the method described in Example 1. Chemical analysis of the bar revealed the following composition, with the remainder being iron:

| Element | Weight % |
|---|---|
| C | 0.460 |
| V | 0.077 |
| Mn | 1.110 |
| Si | 0.270 |
| P | 0.014 |
| S | 0.034 |
| Cu | 0.330 |
| Ni | 0.170 |
| Cr | 0.230 |
| Mo | 0.040 |
| Sn | 0.015 |

EXAMPLE 7

The rebar formed according to Example 6 had the following properties:

| | |
|---|---|
| Yield K.S.I. | 103.0 |
| Tensile K.S.I. | 140.6 |
| % elongation | 9.0 |

EXAMPLE 8

Rebar having a diameter of 0.804 inch was made in a manner similar to the method described in Example 1. Chemical analysis of the bar revealed the following composition, with the remainder being iron:

| Element | Weight % |
|---|---|
| C | 0.440 |
| V | 0.082 |
| Mn | 1.190 |
| Si | 0.290 |
| P | 0.021 |
| S | 0.032 |
| Cu | 0.430 |
| Ni | 0.090 |
| Cr | 0.160 |
| Mo | 0.020 |
| Sn | 0.015 |

EXAMPLE 9

The rebar formed according to Example 8 had the following properties:

| | |
|---|---|
| Yield K.S.I. | 101.0 |
| Tensile K.S.I. | 140.6 |
| % elongation | 10.0 |

Although the present invention has been described in detail in connection to the discussed embodiments, various modifications may be made by one of ordinary skill in the art without departing from the spirit and scope of the present invention. Therefore, the scope of the present invention should be determined by the attached claims.

I claim:

1. A mine roof bolt comprising a rebar formed into an elongated body having a substantially uniform cross section, a first end for entering a bore hole in a rock strata of a mine, and a second end opposite the first end for engagement with a bolting machine to permit installation of the roof bolt within the rock strata, the rebar having 0.44–0.52 wt. % C, 1.1–1.6 wt. % Mn, 0.15–0.35 wt. % Si, a maximum of 0.04 wt. % P, a maximum of 0.05 wt. % S, a maximum of 0.45 wt. % Cu and 0.06–0.09 wt. % V.

2. The mine roof bolt of claim 1 further including a trace to 0.20 wt. % Ni, a trace to 0.25 wt. % Cr and a trace to 0.05 wt. % Mo.

3. The mine roof bolt of claim 1 further including a maximum of 0.02 wt. % Sn or a maximum of 0.02 wt. % Cb or both.

4. The mine roof bolt of claim 1 wherein said rebar has a minimum yield strength of 90,000 psi.

5. The mine roof bolt of claim 4 wherein the diameter of said bolt is about ⅝ inch.

6. A mine roof bolt comprising rebar formed into an elongated body having a substantially uniform cross section, a first end for entering a bore hole in a rock strata of a mine, and a second end opposite the first end for engagement with a bolting machine to permit installation of the roof bolt within the rock strata, the rebar being formed from a steel alloy containing vanadium and said bolt having a minimum yield strength of 90,000 psi.

7. The mine roof bolt of claim 6 wherein the diameter of said bolt is about ⅝ inch.

8. The mine roof bolt of claim 6 wherein the minimum yield strength is 100,000 psi.

9. The mine roof bolt of claim 8 wherein the diameter of said bolt is about 1 inch or about ⅞ inch.

10. A mine roof bolt comprising a rebar having a cross-sectional diameter of about ⅝ inch and a minimum yield strength of 90,000 psi.

11. A mine roof bolt comprising a rebar having a cross-sectional diameter of about 1 inch and a minimum yield strength of 100,000 psi.

12. A mine roof bolt comprising a rebar having a cross-sectional diameter of about ⅞ inch and a minimum yield strength of 100,000 psi.

* * * * *